US008528639B2

(12) United States Patent
Fang et al.

(10) Patent No.: US 8,528,639 B2
(45) Date of Patent: Sep. 10, 2013

(54) METHOD FOR ACCELERATING START-UP FOR STEAM-ASSISTED GRAVITY DRAINAGE (SAGD) OPERATIONS

(75) Inventors: Windsong Fang, Houston, TX (US); Thomas J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 165 days.

(21) Appl. No.: 13/042,152

(22) Filed: Mar. 7, 2011

(65) Prior Publication Data

US 2012/0227965 A1 Sep. 13, 2012

(51) Int. Cl.
*E21B 43/24* (2006.01)

(52) U.S. Cl.
USPC ..... 166/272.3; 166/272.1

(58) Field of Classification Search
None
See application file for complete search history.

(56) References Cited

U.S. PATENT DOCUMENTS

| | | | | |
|---|---|---|---|---|
| 4,344,485 | A * | 8/1982 | Butler | 166/271 |
| 5,215,146 | A | 6/1993 | Sanchez | |
| 5,931,230 | A * | 8/1999 | Lesage et al. | 166/303 |
| 6,318,464 | B1 | 11/2001 | Mokrys | |
| 6,662,872 | B2 * | 12/2003 | Gutek et al. | 166/272.4 |
| 6,708,759 | B2 * | 3/2004 | Leaute et al. | 166/272.4 |
| 6,883,607 | B2 * | 4/2005 | Nenniger et al. | 166/272.4 |
| 7,464,756 | B2 * | 12/2008 | Gates et al. | 166/272.3 |
| 2011/0174488 | A1 * | 7/2011 | Morris et al. | 166/305.1 |

FOREIGN PATENT DOCUMENTS

WO 2009067503 5/2009

* cited by examiner

*Primary Examiner* — Angela M DiTrani
*Assistant Examiner* — Silvana Runyan
(74) *Attorney, Agent, or Firm* — ConocoPhillips Company

(57) ABSTRACT

A method for accelerating start-up for steam assisted gravity drainage operations comprising the steps of: forming a steam-assisted gravity drainage production well pair comprising an injection well and a production well within a formation; beginning a pre-soaking stage by soaking one or both of the wellbores of the well pair with a solvent; beginning a pre-heating stage by heating the wellbores of the well pair; beginning a squeezing stage by injecting steam into the wellbores of the well pair; and beginning steam-assisted gravity drainage production.

15 Claims, 1 Drawing Sheet

METHOD FOR ACCELERATING START-UP FOR STEAM-ASSISTED GRAVITY DRAINAGE (SAGD) OPERATIONS

TECHNICAL FIELD

This invention relates generally to a method for accelerating start-up for steam assisted gravity drainage (SAGD) operations.

BACKGROUND OF THE INVENTION

A variety of processes are used to recover viscous hydrocarbons, such as heavy crude oils and bitumen, from underground deposits. There are extensive deposits of viscous hydrocarbons throughout the globe, including large deposits in the Northern Alberta tar sands, that are not recoverable with traditional oil well production technologies. A problem associated with producing hydrocarbons from such deposits is that the hydrocarbons are too viscous to flow at commercially viable rates at the temperatures and pressures present in the reservoir. In some cases, these deposits are mined using open-pit mining techniques to extract the hydrocarbon-bearing material for later processing to extract the hydrocarbons.

Alternatively, thermal techniques may be used to heat the reservoir fluids and rock to produce the heated, mobilized hydrocarbons from wells. One such technique for utilizing a single well for injecting heated fluids and producing hydrocarbons is described in U.S. Pat. No. 4,116,275, which also describes some of the problems associated with the production of mobilized viscous hydrocarbons from horizontal wells.

One thermal method of recovering viscous hydrocarbons using two vertically spaced wells is known as steam-assisted gravity drainage (SAGD) process. The SAGD process is currently the only commercial process that allows for the extraction of bitumen at depths too deep to be strip-mined. For example, the estimated amount of bitumen that is available to be extracted via SAGD constitutes approximately 80% of the 1.3 trillion barrels of bitumen in place in the Athabasca oilsands in Alberta, Canada. Various embodiments of the SAGD process are described in Canadian Patent No. 1,304,287 and corresponding U.S. Pat. No. 4,344,485. In the SAGD process, steam is pumped through an upper, horizontal injection well into a viscous hydrocarbon reservoir while the heated, mobilized hydrocarbons are produced from a lower, parallel, horizontal production well vertically spaced proximate to the injection well. The injection and production wells are typically located close to the bottom of the hydrocarbon deposits.

The SAGD process is believed to work as follows. The injected steam creates a "steam chamber" in the reservoir around and above the horizontal injection well. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The heated, mobilized hydrocarbons (and steam condensate) drain under the effects of gravity towards the bottom of the steam chamber, where the production well is located. The mobilized hydrocarbons are collected and produced from the production well. The rate of steam injection and the rate of hydrocarbon production may be modulated to control the growth of the steam chamber to ensure that the production well remains located at the bottom of the steam chamber and in a position to collect the mobilized hydrocarbons.

In order to initiate a SAGD production, thermal communication must be established between an injection and a production SAGD well pair. Initially, the steam injected into the injection well of the SAGD well pair will not have any effect on the production well until at least some thermal communication is established because the hydrocarbon deposits are so viscous and have little mobility. Accordingly, a start-up phase is required for the SAGD operation. Typically, the start-up phase takes about three months before thermal communication is established between the SAGD well pair, depending on the formation lithology and the actual inter-well spacing.

The traditional approach to starting-up the SAGD process is to simultaneously operate the injection and production wells independently of one another to circulate steam. The injection and production wells are each completed with a screened (porous) casing (or liner) and an internal tubing string extending to the end of the liner, forming an annulus between the tubing string and casing. High pressure steam is simultaneously injected through the tubing string of both the injection and production wells. Fluid is simultaneously produced from each of the injection and production wells through the annulus between the tubing string and the casing. In effect, heated fluid is independently circulated in each of the injection and production wells during the start-up phase, heating the hydrocarbon formation around each well by thermal conduction. Independent circulation of the wells is continued until efficient thermal communication between the wells is established. In this way, an increase in the fluid transmissibility through the inter-well span between the injection and production wells is established by conductive heating. The pre-heating stage typically takes about three to four months. Once sufficient thermal communication is established between the injection wells, the upper, injection well is dedicated to steam injection and the lower, production well is dedicated to fluid production. Canadian Patent No. 1,304,287 teaches that in a SAGD start-up process, while the injection and production wells are being operated independently to inject steam, the steam must be injected through the tubing string and fluid collected through the annulus, not the other way around. The patent discloses that if steam is injected through the annulus and fluid collected through the tubing string, the steam looses heat to both the formation and the tubing string (and its contents), causing the injected steam to condense before reaching the end of the well.

U.S. Pat. No. 5,215,146 describes a method for reducing start-up time in SAGD operation by maintaining a pressure gradient between the upper and lower wells with foam. The pressure gradient forces the hot fluids from the upper well to the lower well. However, the method adds undesired costs and maintenance requirements due to the need to create downhole foam which is typically not required in a SAGD process.

WO 99/67503 teaches a method for initiating the recovery of hydrocarbons by injecting heated fluids into the hydrocarbon deposit through an injection well while withdrawing fluids from a production well. The flow of the heated fluid between the injection and the production wells warms the reservoir fluids and rock between the wells to establish suitable conditions for recovery of hydrocarbons. However, the method adds undesired costs and maintenance requirements due to the need to inject heated fluids which are not typically required in a SAGD process.

Accordingly, an accelerated start-up method is needed to decrease the start-up time for SAGD operation that does not require the injection of heated fluids or the creation of downhole foam. Further, such a start-up method should accelerate start-up of SAGD operations without adversely impacting production from the SAGD well pair.

SUMMARY OF THE INVENTION

This invention relates generally to a method to accelerate start-up of steam assisted gravity drainage (SAGD) operations. In particular, the method reduces the pre-heating time (e.g., steam circulation time) required to establish thermal communications between an injector and a producer of a SAGD well pair.

The invention accelerates start-up of SAGD operations by quickly establishing thermal communication between an injector and a producer of a SAGD well pair during the pre-heating stage (e.g., steam circulation period) and, thereby, decreasing the pre-heating time required to mobilize the hydrocarbons. The method relies on solvent and thermal benefits to reduce the viscosity of heavy crude oil or bitumen. The solvent benefits are provided by an initial solvent pre-soaking of the wellbores, which reduces the viscosity hydrocarbon deposits in the nearby formation. The thermal benefits are provided by conductive and convective heating of formation fluids and rock between the SAGD well pair through a pre-heating stage followed by short squeezing stage of steam injection. As a result, thermal communication is established more quickly between the SAGD well pair during the start-up period.

These and other objects, features, and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present inventions, reference should be made to the following detailed disclosure, taken in conjunction with the accompanying drawings, in which like parts are given like reference numerals, and wherein.

DETAILED DESCRIPTION OF PREFERRED EMBODIMENTS OF THE INVENTIONS

Figure 1:
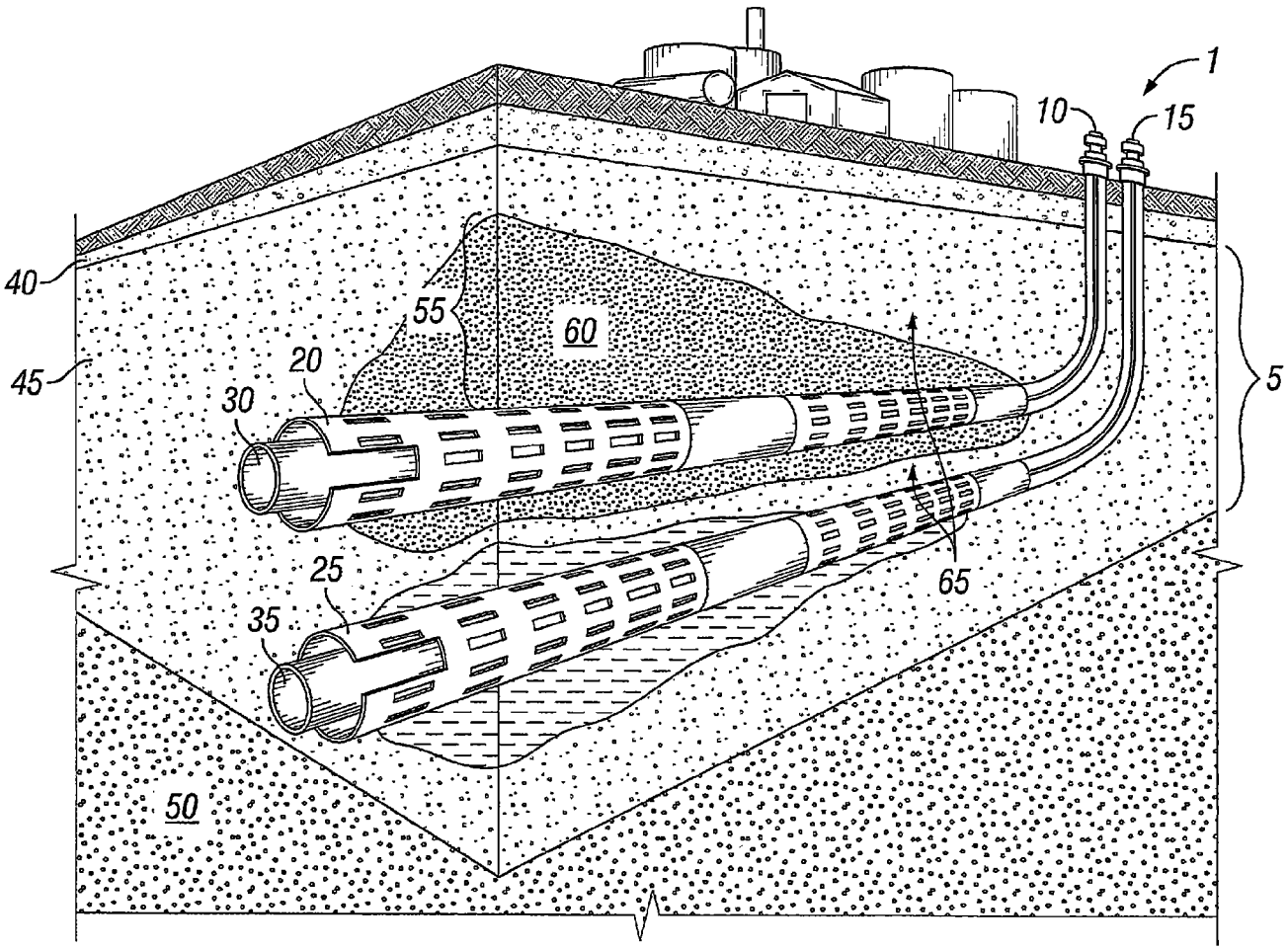
FIG. 1 is a perspective side view of an exemplary well pair for steam-assisted gravity drainage (SAGD) production.

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto to be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

The present invention uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical ranges of about 1 to 10 provides literal support for a claim reciting "greater than 1" (with no upper bounds) and a claim reciting "less than 10" (with no lower bounds).

An exemplary well pair for steam-assisted gravity drainage (SAGD) production is shown in FIG. 1. As shown in FIG. 1, the SAGD well pair 1 is drilled into a formation 5 with one of the wells vertically spaced proximate to the other well. The injection well 10 is an upper, horizontal well, and the production well 15 is a lower, parallel, horizontal well vertically spaced proximate to the injection well 10. In a preferred embodiment, the injection well 10 is vertically spaced about 4 to 10 meters above the production well 15. In an especially preferred embodiment, the injection well 10 is vertically spaced about 5 to 6 meters above the production well 15. In a preferred embodiment, the SAGD well pair 1 is located close to the bottom of the oilsands 45 (i.e., hydrocarbon deposits). Generally, the oilsands 45 are disposed between caprock 40 and shale 50.

The SAGD well pair 1 comprises an injection well 10 and a production well 15. The injection well 10 further comprises an injection borewell 20 and a first production tubing string 30, wherein the first production tubing string 30 is disposed within the injection borewell 20, and has a first return to surface capable of being shut-in. Similarly, the production well 15 further comprises a production borewell 25 and a second production tubing string 35, wherein the second production tubing string 35 is disposed within the production borewell 25, and has a second return to surface capable of being shut-in. In a preferred embodiment, the injection 10 and production 15 wells are both completed with a screened (porous) casing (or liner) and an internal production tubing string 30, 35 extending to the end of the liner, and forming an annulus between the tubing string 30, 35 and wellbore (or casing) 20, 25.

During SAGD production, the upper well 10 (i.e., the injection well) injects steam 60, possibly mixed with other solvents, and the lower well 15 (i.e., the production well) collects the heated, mobilized crude oil or bitumen 65 that flows out of the formation 5 along with any water and/or solvents from the condensate of the injected fluids. A start-up phase is required for the SAGD operation. Initially, the steam 60 injected into the injection well 10 of the SAGD well pair 1 will not have any effect on the production well until at least some thermal communication is established because the hydrocarbon deposits are so viscous and have little mobility. The injected steam 60 and/or solvents eventually form a "steam chamber" 55 that expands vertically and laterally into the formation 5. The heat from the steam 60 reduces the viscosity of the heavy crude oil or bitumen 65, which allows it to flow down into the lower wellbore 25 (i.e., the production wellbore). The steam and/or solvent gases rise due to their relatively low density compared to the density of the heavy crude oil or bitumen 65 below. Further, gases including methane, carbon dioxide, and, possibly, some hydrogen sulfide are released from the heavy crude or bitumen, and rise in the steam chamber 55 to fill the void left by the draining crude oil or bitumen 65. The heated crude oil or bitumen 65 and condensed steam flows counter to the rising gases, and drains into the production wellbore 25 by gravity forces. The crude oil or bitumen 65 and water is recovered to the surface by pumps such as progressive cavity pumps that are suitable for moving high-viscosity fluids with suspended solids. The water may be separated from the crude oil or bitumen and recycled to generate more steam.

This invention relates generally to a method to accelerate the start-up of SAGD operations. In particular, the method reduces the pre-heating time (e.g., steam circulation time) required to establish thermal communication between an injector 10 and a producer 15 of the SAGD well pair 1. Specifically, the invention accelerates start-up of steam assisted gravity drainage (SAGD) operations by quickly establishing thermal communication between an injector 10 and a producer 15 of the SAGD well pair 1 during the pre-heating stage, and, thereby, decreasing the pre-heating time required. The method relies on solvent and thermal benefits to reduce the viscosity of heavy crude oil or bitumen 65. The solvent benefits are provided by an initial solvent pre-soaking of the wellbores, which reduces the viscosity of the hydrocarbon deposits in the nearby of formation. The thermal benefits are provided by conductive and convective heating of formation fluids and rock between the SAGD well pair 1 through a pre-heating stage followed by short squeezing stage of steam injection. As a result, thermal communication is established more quickly between the SAGD well pair 1 during the start-up period.

In an embodiment, a method for accelerating start-up for steam-assisted gravity drainage operations comprising the steps of forming a steam-assisted gravity drainage production well pair 1 within a formation 5 comprising an injection well 10 and a production well 15. The injection well 10 further comprises an injection wellbore (or casing) 20; and a first production tubing string 30; wherein the first production tubing string 30 is disposed within the injection wellbore (or casing) 20, extending to an end of the wellbore 20 and forming an annulus between the tubing string 30 and the wellbore (or casing) 20, and wherein the tubing string 30 has a first return to surface capable of being shut-in. Similarly, the production well 15 further comprises a production wellbore (or casing) 25; and a second production tubing string 35, wherein the second production tubing string 35 is disposed within the production wellbore (or casing) 25, extending to an end of the wellbore 25 and forming an annulus between the tubing string 35 and the wellbore (or casing) 25, and wherein the tubing string 35 has a second return to surface capable of being shut-in.

The method further comprises the step of beginning a pre-soaking stage by soaking one or both of the wellbores 20, 25 of the SAGD well pair 1 with a solvent. When a new SAGD well pair 1 is drilled, there are usually several months of idle/wait time before steam and/or other facilities are available to the wells. This invention makes use of this idle period to pre-soak one or both of the wellbores 20, 25.

One or both of the wellbores 20, 25 may be pre-soaked with a liquid or a gaseous solvent that is soluble in heavy crude oil or bitumen 65. In the case of a liquid solvent, one or both of the wellbores 20, 25 are gravity fed or pumped with the liquid solvent for pre-soaking stage of a few months before SAGD production start-up. The liquid solvent may be selected from the group consisting of butane, pentane, hexane, diesel and mixtures thereof. The liquid solvent may be gravity fed or pumped through the tubing string 30, 35 or through the annulus formed between the tubing string 30, 35 and the wellbore (or casing) 20, 25. In a preferred embodiment, the pre-soaking stage is about 2 to 3 months. In an especially preferred embodiment, the pre-soaking stage is no more than about 4 months.

In the case of a gaseous solvent, one or both of the wellbores 20, 25 are continuously injected with a gaseous solvent for a few months before start-up. The gaseous solvent may be combined with steam and may be selected from the group consisting of air, carbon dioxide, methane, ethane, propane, natural gas and mixtures thereof. The gaseous solvent may be injected through the tubing string 30, 35 or through the annulus formed between the tubing string 30, 35 and the wellbore (or casing) 20, 25 because the solvent does not need to be heated. In a preferred embodiment, the pre-soaking stage is about 2 to 3 months. In an especially preferred embodiment, the pre-soaking stage is no more than about 4 months.

In an embodiment, the method comprises the step of beginning a pre-heating stage by heating the wellbores 20, 25 of the SAGD well pair 1. The wellbores 20, 25 are pre-heated with a heated fluid or other heating mechanism for a few months before SAGD production start-up. Heating methods include electric, electromagnetic, microwave, radio frequency heating and steam circulation. In a preferred embodiment, the wellbores 20, 25 may be pre-heated with steam circulation for about 0.5 to 3 months. The pre-heating may be completed in the same manner as with a conventional SAGD start-up. In a preferred embodiment, the steam is circulated in one or both of the wellbores (or casings) 20, 25 of an injector 10 and a producer 15 of the SAGD well pair 1. In a preferred embodiment, the pre-heating stage is about 1 to 3 months. In an especially preferred embodiment, the pre-heating stage is about one month.

In an embodiment, the method comprises the step of beginning a squeezing stage by injecting steam into the wellbores 20, 25 of the well pair 1. The wellbores 20, 25 are injected with steam for a few days to a few weeks. In an embodiment, the pre-heating is stopped, and steam is injected into the wellbores 20, 25. In an embodiment, the steam circulation is stopped and the returns to surface of the injection well 10 and production well 15 production tubing strings 30, 35 are shut-in to force the injected steam into the formation 5. In a preferred embodiment, the squeezing stage is at least 1 day. In an especially preferred embodiment, the squeeze stage is about 1 to 30 days.

In an embodiment, the method comprises beginning steam-assisted gravity drainage production. Once efficient thermal communication is established between the SAGD well pair 1, the upper well 10 is dedicated to steam injection, and the lower well 15 is dedicated to fluid production. In a preferred embodiment, the steam injection is shut-in for the production 15 well, and the SAGD well pair 1 begins SAGD production, as discussed above.

Simulation studies using a numerical simulator such as CMG STARS™ (2007.10) and a 3-D reservoir model have shown that pre-soaking the wellbores with solvents for about 2 to 3 months before pre-heating (e.g., steam circulation) the wellbores for a pre-heating stage of about one-month, and squeezing with steam injection into the formation for about 1 to 30 days can reduce the traditional start-up phase from about 3 to 4 months to about 1 month without adversely impacting production from the SAGD well pair.

The benefit of pre-soaking with solvents before and squeezing with steam injection after a month of pre-heating with steam circulation is two fold: 1) the solvents reduce the viscosity of the hydrocarbon deposits, and 2) the squeezed steam introduces convective heating, which is more efficient than conductive heating. With the benefit of solvent pre-soaking, the injected steam can penetrate the formation fluids more quickly and establish its injected volume in the formation more efficiently. The injected steam introduces the convection heat transfer mechanism into the formation, which promotes the thermal communication between the SAGD well pair. Accordingly, the present invention reduces the traditional pre-heating period by about two months, and accelerates start-up for steam-assisted gravity drainage operations from a SAGD well pair without adversely impacting production from the well pair.

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone: A and B in combination; A and C in combination; B and C in combination; or A, B, and C in combination.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the term "liquid" as applied to the treatment medium includes liquid and dense phase states also known as critical and super critical states.

As used herein, the term "simultaneously" means occurring at the same time or about the same time, including concurrently.

What is claimed is:

1. A method for accelerating start-up for steam assisted gravity drainage operations comprising the steps of:

a) forming a steam-assisted gravity drainage production well pair within a formation comprising an injection well and a production well;

b) beginning a pre-soaking stage by soaking at least one of the wellbores of the well pair with a solvent;

c) beginning a pre-heating stage by heating the soaked wellbore of the well pair by one of electric, electromagnetic, microwave, radio frequency heating and steam circulation within the wellbore;

d) beginning a squeezing stage by injecting steam into the soaked wellbore of the well pair while returns to surface are shut-in to force the steam into the formation; and then e) beginning steam-assisted gravity drainage production.

2. The method of claim 1, wherein the pre-soaking stage is no more than about 4 months.

3. The method of claim 1, wherein the pre-soaking stage is about 2 to 3 months.

4. The method of claim 1, wherein the solvent is selected from the group consisting of butane, pentane, hexane, diesel, and mixtures thereof.

5. The method of claim 1, wherein the solvent is selected from the group consisting of air, carbon dioxide, methane, ethane, propane, natural gas and mixtures thereof.

6. The method of claim 1, wherein the pre-heating stage is about 1 to 3 months.

7. The method of claim 1, wherein the pre-heating stage is about one month.

8. The method of claim 1, wherein the squeezing stage is at least 1 day.

9. The method of claim 1, wherein the squeezing stage is about 1 to 30 days.

10. The method of claim 1, wherein the injection and production wells are parallel, horizontal, and vertically spaced apart.

11. The method of claim 10, wherein the injection and production wells are vertically spaced about 4 to 10 meters apart.

12. The method of claim 10, wherein the injection and production wells are vertically spaced about 5 to 6 meters apart.

13. A method for accelerating start-up for steam-assisted gravity drainage operations comprising the steps of:

a) forming a steam-assisted gravity drainage well pair comprising:

i. an injection well; and ii. a production well; and iii. wherein the injection well is vertically spaced proximate to the production well;

b) beginning a pre-soaking stage by soaking at least one of the wellbores of the well pair with a solvent;

c) beginning a pre-heating stage by heating the soaked wellbore of the well pair by one of electric, electromagnetic, microwave, radio frequency heating and steam circulation within the wellbore;

d) stopping the heating of step (c), and beginning a squeezing stage by injecting steam into that wellbore while returns to surface are shut-in to force the steam into the formation; and then e) beginning steam-assist gravity drainage production.

14. The method of claim 1, wherein the soaked wellbore is pre-heated by circulating steam.

15. A method of accelerating start-up for steam assisted gravity drainage operations, comprising:

a) forming a steam-assisted gravity drainage production well pair within a formation and comprising an injection well and a production well;

b) pre-soaking at least one of the wells of the well pair with a solvent; then c) pre-heating the well pair by steam circulation within the wells to heat the formation by conduction; then d) squeezing to further heat the formation by convection with steam injected through the wells while returns to surface are shut-in to force the steam into the formation with penetration established where the solvent already reduced viscosity of formation fluids; and then e) injecting steam into the injection well while producing fluids from the production well for steam-assisted gravity drainage production.

* * * * *